United States Patent [19]

Furuno

[11] Patent Number: 4,504,324

[45] Date of Patent: Mar. 12, 1985

[54] SURFACE TREATMENT OF ALUMINUM MATERIALS

[75] Inventor: Nobuo Furuno, Hyogo, Japan

[73] Assignee: Nippon Paint Co., Ltd., Osaka, Japan

[21] Appl. No.: 549,545

[22] Filed: Nov. 7, 1983

[51] Int. Cl.[3] ..... C23F 7/08; C23F 7/26

[52] U.S. Cl. ..... 148/6.15 R; 148/6.2; 148/6.27; 148/6.24

[58] Field of Search ..... 148/6.27, 6.15 R, 6.2, 148/6.24

[56] References Cited

U.S. PATENT DOCUMENTS

| | | | |
|---|---|---|---|
| 2,137,988 | 11/1938 | Hempel | 148/6.27 |
| 2,650,875 | 9/1953 | Dvorkovitz | 148/6.27 |
| 2,883,311 | 8/1959 | Halpert | 148/6.27 |
| 2,948,392 | 8/1960 | Young | 148/6.27 |
| 3,066,055 | 11/1962 | Pimbley | 148/6.27 |

*Primary Examiner*—Sam Silverberg

*Attorney, Agent, or Firm*—Wenderoth, Lind & Ponack

[57] ABSTRACT

A method for the treatment of aluminum or aluminum alloy material comprising treating the material in a series of alkaline baths and a series of acid baths connected in series in regular order, said alkaline baths having an alkali concentration gradient continually decreasing from higher to lower values, the alkali concentration in the last stage bath being controlled to a defined level, and said acid baths having an acid concentration gradient continually decreasing from higher to lower values and the last stage bath being of pure water. The aluminum or aluminum alloy surface can be processed uniformly and economically by the instant process.

4 Claims, No Drawings

SURFACE TREATMENT OF ALUMINUM MATERIALS

FIELD OF THE INVENTION

The present invention relates to a method for the treatment of aluminum materials and more specifically to a method for the treatment of aluminum materials to give uniform surfaces of controlled surface properties. The term "aluminum materials" as used herein denotes "molded materials made of aluminum or aluminum rich alloys and materials metallized therewith".

BACKGROUND OF THE INVENTION

Aluminum is said to be one of the most reactive metals and is easily oxidized in air to form an oxide film thereupon. In a pure aluminum material, the said film is quite dense and can exhibit excellent corrosion resistance. However, in the case of aluminum alloy material having an increased strength to withstand practical use, oxide film formation is uneven, resulting in inferior corrosion resistance of the film. Furthermore, in order to obtain an aluminum material with improved alkali or chemical resistance, it is essential that the material be covered with an organic coating. However, the coating applied onto an aluminum material having a spontaneously made oxide film is liable to be easily peeled off. Thus, it is generally accepted that application of coating on an aluminum material is indeed a difficult job. Under the circumstances, various attempts have been proposed to subject an aluminum material, after removing naturally formed uneven oxide film therefrom by etching and prior to the subsequent coating, to a surface treatment capable of controlling the surface characteristics uniformly. These proposals may be divided in two groups, i.e. the so-called "chemical conversion method" and "anodic oxidation method". Among them, the former is to provide an oxidized, phosphated or chromated film on the aluminum material through chemical reactions in a chemical reagent solution of defined composition. The film forming mechanism involved is believed to be such that insoluble salts such as phosphate, chromate or the like are precipitated on the aluminum surfaces by making use of pH change which occurs at the time when the aluminum material is subjected to an oxidative dissolution (etching). Therefore, the bath composition used in the chemical conversion coating treatment is naturally changed progressively with the advancement of said film-formation and hence, it is unavoidable that the composition and structure of the formed film fluctuates little by little with time. Consequently, how long the film formation can be stably and continuously realized is a matter of importance in industry and for this end, studies have concentrated on having an improved bath composition with higher buffering capacity.

Thus, an extremely large number of methods have been developed as, for example, MBV method, EW method, Pylumin method, Alrok method, Protal method, Jirotka method, Phosphoric acid method, Phosphoric-chromic acids method, Alodine method, Alochrome method and the like, and new proposals using novel bath compositions have been made successively even at the present time. The main parameter of chemical conversion treatment bath composition is the balance between the free acidity capable of determining etching of aluminum and total acidity relating to the formation of film. On the basis of this parameter, are determined correlations with various additive compositions and complicated administrative operations. However, such operations naturally require skillful techniques. Moreover, since the change of bath composition with time is unavoidable, there is of course a certain limit in the improvement in productivity and in the film performance after all. Thus, no definite chemical conversion method has been established up to this time. On the other hand, the anodic oxidation method is characterized by conducting an electrolysis, using the aluminum as an anode, thereby forming an oxidized film on the same. In that method, etching is performed with an electrolyte of simple composition such as sulfuric acid, oxalic acid and the like, and film formation is controlled by the electrolysis conditions. This method may constantly give uniform products for a longer period of time and guarantee a higher productivity and quality in an industrial scale production as compared with those of chemical conversion coating treatment, and hence is now the preferred method in the treatment of aluminum materials. In fact, ever since a combination system (called Hanilight method) of said azodic oxidation method and electrodeposition coating method had been proposed, aluminum has become used in larger quantities in the area of construction materials such as sash and the like. Therefore, anodizing is the most typical surface treatment method in the present day. Thus, an anodic oxidation is, indeed, an excellent method, but since it requires a large current density on the order of more than 1 $A/dm^2$ for more than 30 minutes, there still remains unsolved questions of higher cost, productivity, working environmental problems and the like.

Particularly, since a larger quantity of electricity had already been spent for the production of aluminum ingots, additional consumption of larger electricity in the subsequent anodic oxidation is undesirable from the standpoint of production cost and efficient utilization of aluminum material. Furthermore, in an anodic oxidation, a crystalloid (up to $10\mu$), porous oxidized coating is usually obtained, which is, though being desirable in improving surface hardness and enhancing the product value, often undesirable from the standpoint of bending processability of the painted product.

Porous surface is indeed beneficial for the adhesion of over coating, but is undesirable from the anticorrosive point of view. Therefore, it is essential to use after treatment such as additional coating or sealing. Thus, in connection with surface treatment of aluminum material, it is hardly possible to obtain satisfactory products with uniform surface characteristics, whereas in the anodic oxidation method, it is only feasible to obtain products with hard surfaces. Therefore, in the market area where hard surfaces of the products are not required, it has long been desired to develop a surface treatment technique for aluminum material capable of resulting in products with excellent bending and processing properties after coating, and being superior to an anodic oxidation process in respect of adhesion to the coating and corrosion resistance of the treated products.

The inventors, having considered a series of techniques heretofore proposed concerning the surface treatment of aluminum material, comprising defatting, washing, etching, washing, neutralization, washing, chemical conversion treatment and washing, and taking them as necessary steps for giving an aluminum material a uniform surface maintained under controlled conditions, have completed the present invention.

SUMMARY OF THE INVENTION

According to the invention, there is provided a method for the surface treatment of aluminum materials which is characterized in that aluminum material is treated in regular succession in treatment baths, connected in series, of multi-stage alkaline baths and multi stage acid baths, said alkaline baths having an alkali concentration gradient continually decreasing from higher to lower values, the alkali concentration of the last stage bath being controlled to a defined level, and said acid baths having an acid concentration gradient continually decreasing from higher to lower values and the last stage bath being pure water.

PREFERRED EMBODIMENTS OF THE INVENTION

Since an aluminum material is contaminated by grease, fats and oils, dust and dirt and the like, it is customarily degreased with an organic solvent or the like and washed with water prior to the surface treatment thereof. As already stated, aluminum is a quite active metal. It is easily reacted with water to give, as shown in the following, hydrogen gas and aluminum hydroxide:

$$2Al+6H_2O \rightarrow 2Al(OH)_3+3H_2 \uparrow$$

the latter undergoing the following change to form oxidized film of various compositions.

$$2Al(OH)_3 \rightarrow Al_2O_3nH_2O+3(3-n)H_2O$$

Since the surrounding atmosphere on aluminum undergoes change in various modes including temperature, moisture and the like, the abovesaid n may vary in a considerable range of more than 1 with the abovesaid change (i.e. heterogeneous state), and under more strongly corrosive atmosphere, futher oxidation may occur, thereby resulting in film with other constitution.

Therefore, in order to obtain a uniform aluminum surface, it is essential to once remove the abovesaid heterogeneous oxide film of various modes, this step being known as an etching operation.

As an etching for aluminum, use is often made of chemical polishing of dipping type because of application ease for complicated structure materials, though there are other methods such as mechanical polishing, electrolysis polishing and the like. In the case of aluminum, etching may be successfully carried out by either acid or alkali substance, said etching typically including the following:

acid etching: $Al+3HCl \rightarrow AlCl_3+3/2H_2 \uparrow$ alkali etching:
$Al+3H_2O+NaOH \rightarrow NaAl(OH)_4+3/2H_2 \uparrow$ The formed salt in an acid etching has a considerable degree of solubility characteristics and one may use even a dilute acid. However, since the acid is consumed in said etching, it is not possible to control the etching speed unless otherwise supplementing the consumed acid successively.

On the other hand, in the case of alkali etching, water soluble aluminum complex ion is decomposed, with the decrease in bath temperature, as shown in the following:

$$NaAl(OH)_4 \rightarrow NaOH+2Al(OH)_3 \rightarrow NaOH+\tfrac{1}{2}Al_2O_3+3/2H_2O$$

and the same alakaline substance as used in the alkali etching can be reproduced, together with the formation of aluminum oxide sludge. This may be interpreted such that a highly concentrated alkali substance is utilized as a catalyst for the oxidation of aluminum with water. Thus, the process is characterized by effecting an aluminum etching continuously without supplementing the alkali substance after all.

It is quite easy to control the alkali concentration and therefore, the only importance for the success in the control of etching speed does reside in the temperature of the alkaline bath. Thus, the alkali etching is far superior to the acid etching in the case of aluminum. In fact, for aluminum etching, the most typical and advantageous method is an alkali etching. After carrying out an alkali etching, the aluminum material is usually washed well with water to remove the remaining alkali substance therefrom. However, said alkali can not completely be removed by the mere washing and therefore, neutralization with an acid, in most cases with nitric acid, is subsequently carried out. At this time, aluminum etching might necessarily occur when such acid as hydrochloric acid and the like is used for the neutralization purpose. However, such cannot be found with nitric acid, and a very stable, passive state can be obtained therewith. In the case of aluminum alloy, even if the contained heavy metals which have not been dissolved out at the time of alkali etching do remain on the aluminum surface and cause coloring thereof, it is possible to dissolve smut out of the aluminum surface(desmut) with said nitric acid, thereby effecting decoloration, and therefore, this particular acid has been widely used for neutralization up to the present day.

After neutralization with an acid, the aluminum is washed with water to remove the remaining acid and then subjected to chemical conversion treatment with various conversion compositions. However, even adopting a series of processings of alkali etching—washing—neutralization—washing, though it is possible to remove the oxide film formed by spontaneous oxidation on the aluminum surface, it is not possible to bring the surface characteristics of the aluminum material to a uniformly controlled condition. Therefore, in a chemical conversion coating treatment, it is customarily required to add to the treating bath various chemicals capable of giving etching and film-forming functions thereto.

The inventors, from the detailed and careful analysis of each step involved in heretofore proposed surface treating methods, have found that such methods do possess many repetitions of useless or meaningless steps for the homogenization of surface characteristics of aluminum materials. That is, in the washing step after alkali etching, water soluble complex ions on the aluminum surface will be converted to water insoluble aluminum hydroxide with the progress of removing alkaline substance therefrom;

$$Al(OH)_4^{31} \rightarrow Al(OH)_3$$

and said hydroxide will appear as a deposit in a colloidal state on said aluminum surface. Thus formed deposit cannot be removed by the mere adoption of dipping and washing operations. Even if the deposit is removed by the mechanical force of running water, spraying or the like, the exposed aluminum per se will react immediately with water:

$$Al+3H_2O \rightarrow Al(OH)_3+3/2H_2 \uparrow$$

thereby forming aluminum hydroxide again. Moreover, too excessive washing will accelerate the transformation of said aluminum hydroxide and cause the reaction:

$$2Al(OH)_3 \rightarrow Al_2O_3n(H_2O)+3(3-n)H_2O.$$

The figure n will fluctuate in a wider range depending on the water quality, temperature, time or the like in the washing step and there is a tendency that the coating will become amorphous with the increase in n value.

In the heretofore proposed method, even if the aluminum hydroxide layer or oxide film is removed with the help of nitric acid in a neutralization step, the subsequent washing will again produce the same situation, i.e. repetitions of the abovesaid reactions, and will result in a heterogeneous state of surface characteristics after all. Therefore, a considerable etching action has to be accompanied with the chemical conversion coating treatment of thus treated material. The repitition of such acid and alkaline etchings involved in heretofore proposed processes is not only undesirable from the standpoint of natural resources, but also from the quality control of washing water, waste water treatment and the like. Moreover, they are totally useless for the homogenization of aluminum surfaces.

Under the circumstances, in the present invention, etching in a chemical conversion coating treatment is effected in early stages of the treatments with multi-stage alkaline baths having a defined alkali concentration gradient from higher to lower values, and the remaining alkali on the aluminum surface, and finally the quality of the aluminum hydroxide layer, are effectively controlled by the provision of a defined alkali concentration in the last stage bath.

The effective alkali concentrations customarily used in an alkali etching for aluminum or aluminum alloy materials are on the order of 5 to 20% and therefore, the present multi-stage alkaline baths are possessed of an alkali concentration gradient starting from that extent of etching concentration, preferably 3N, and ending with an alkali concentration on the order of $1\times10^{31}$ $6\sim5\times10^{-1}$ N at the final stage bath.

By the adoption of such decreasing alkali concentration gradient, a very similar effect to water washing can be attained. However, since the last stage bath is still under weak alkaline condition, various changes which usually occur in water washing steps of heretofore proposed processes are effectively controlled and the aluminum surface remains covered by a homogeneous aluminum hydroxide coating.

Since the said state is quite labile, the invention adopts an acid treatment in succession as the means for converting the homogeneous but labile surface condition to a passive state thereof. For this purpose, the alkali-treated aluminum material is then treated with multi-stage acid baths having a defined acid concentration gradient from higher to lower acid values, the last stage bath being pure water. When a phosphoric or chromic acid type chemical conversion bath is used, the alkali substance still remaining in a small quantity on said aluminum surface is neutralized therewith and at the same time, the aluminum hydroxide is precipitated out as insoluble phosphates or the like, as shown in the following:

$$Al(OH)_3+H_3P_2O_5 \rightarrow AlP_2O_5 \downarrow +3H_2O$$

When a chemical conversion bath containing monobasic phosphate or the like is used, the phosphoric acid is consumed, converted to dibasic phosphate and finally to tribasic phosphate, thereby forming a water insoluble coating of the latter.

At this time, since the surface of aluminum material to be processed has already been controlled homogeneously beforehand, the so-called etching is not required in this step, and a film-forming function with an acid concentration necessary for the neutralization of aluminum hydroxide layer will be quite enough.

In order to have a controlled, highly efficient thin coating, it is rather preferred to use the minimum acid concentration required for the said neutralization. The present acid baths generally have a defined acid concentration gradient starting from 2N and ending with the last stage bath of pure, deionized water having a specific electrical conductance of less than 10 $\mu$S/cm. By the successive treatments of aluminum material in these baths, one may obtain a very uniform chemical conversion coating. If desired, it is possible to use an acid which is as high as 3N concentration. Evasion of etching in the chemical conversion treatment means that there are no reactions which will cause the generation of hydrogen gas; as, for example, $$Al+H_3P_2O_5 \rightarrow AlP_2O_5+3/2H_2 \uparrow$$

In fact, the present invention has the characteristics of resulting in a dense, uniform coating, differing from the porous coatings obtained by the heretofore known processes.

In the present invention, as an acid bath solution, it is possible to use such oxidative acidic solution as nitric acid, sulfuric acid or perchloric acid solution. Aluminum can be dissolved by hydrochloric acid but not by said oxidative acidic substances. In the case of nitric acid solution, if the acid concentration is sufficiently high, then the aluminum is brought to the passive state and there occurs no etching thereof. Thus, the aluminum acts differently from those of zinc materials, although the detailed actions have not been found yet. Anyway, with the decrease in nitric acid concentration, there occurs activation of aluminum. In the heretofore known process, an acid neutralization is followed by uncontrolled washing, and therefore, aluminum is again oxidized with water and homogenized surface characteristics will be ruined.

However, in the present invention, even if there occurs activation of aluminum during the steps of treatments with multi-stage acid baths having a decreasing acid concentration curve, since the last stage bath is controlled to be composed of pure water having a specific electrical conductance of less than 10 $\mu$S/cm and containing no dissolved ions, and a longer time of washing is evaded, said acid treatment will get no further than the reproduction of quite homogeneous aluminum hydroxide layer. Therefore, following said treatments with acid baths, if the aluminum is subjected to an electrodeposition coating to cover the same or a hot water treatment to convert the aluminum surface to boehmite:

$Al(OH)_3 \rightarrow Al_2O_3.H_2O$ the present objects of homogenizing the aluminum surface, improving the coating adhesion and obtaining a product with excellent working characteristics can be fully attained.

Thus, in the present invention, etching and film-forming are independently carried out, thereby evading the repititions of unnecessary etching operations that are inevitably involved in heretofore known processes, and enabling the homogenization of the aluminum surface condition and free control thereof. Therefore, the invention can afford an aluminum surface with good quality by the film-forming technique which is totally different from those of heretofore known chemical conversion methods, and hence is very useful in industry.

Incidentally, when the aluminum material is heavily stained and oxidized or surface roughness control is desired, the present method may be carried out, combined with heretofore proposed etching operations.

The invention shall be now more fully explained in the following Examples. Unless otherwise stated, all % are by weight. Though the treatments were carried out, by way of illustration, by a dipping method, it is to be understood that the same could also be performed satisfactorily by a spraying method.

In these examples, evaluation of the particular surface treatment was made, after making test specimens by applying onto the treated aluminum material an acryl melamine resin through electrodeposition and baking under identical conditions in each Example and subjecting the same to the following tests, with the evaluation standards hereinunder stated.

Coating thickness:

determined by using eddy-current type film thickness measuring apparatus (permascope EC type)

Sulfurous acid resistance test:

Test specimen was maintained in an atmosphere of closed chamber containing 5% sulfurous acid aqueous solution and kept standing at 20° C. for 24 hours.

. . . no abnormality

Δ . . . partial peeling, generation of blister

X . . . complete peeling

Alkaline resistance test:

Test specimen was dipped in 1% aqueous sodium hydroxide solution at 20° C. for 3 days.

. . . no abnormality

Δ . . . partial corrosion

X . . . severe corrosion

CASS test: according to JIS H 8681

. . . no abnormality

Δ . . . partial corrosion

X . . . severe corrosion

Adhesion test:

Screw core blankings were conducted at +20° C. and −20° C.

. . . processable without any abnormality as peeling and the like

X . . . coat peeling

COMPARATIVE EXAMPLE 1

An aluminum plate (material 6063, size 50×100×1 mm) was dipped in 10% aqueous solution of commercial surfactant (commercial name Finechemister) for 3 minutes to effect degreasing and rinsing, and then washed well with tap water. Thus treated plate was dipped in 7% aqueous sodium hydroxide solution at 55° C. for 3 minutes to effect the removal of spontaneously formed oxide film and the etching, and washed well withh tap water. The plate was then dipped in a diluted (10 times) aqueous solution of commercial reagent grade nitric acid (about 1N) for 3 minutes, washed well with tap water, rinsed with deionized water and electrodeposited by using an electrodeposition bath of water soluble arcyl melamine resin (pH 8.0, non-volatile content 11%) and passing a direct current (applied voltage 100 V) at 30° C. for 2.5 minutes. Thereafter, the plate was taken out, washed with water, air-dried and baked at 190° C. for 30 minutes to obtain the coated plate. Test results with this plate are shown in Table 1.

COMPARATIVE EXAMPLE 2

A similar aluminum plate dipped in nitric acid and washed with tap water as stated in Comparative Example 1 was subjected to an anodic oxidation, using 15% sulfuric acid bath, under the conditions of a current density of 1.3 A/100 $cm^2$, a temperature of 20° C. and a treating time of 30 minutes, and thereafter, electrodeposition coated and baked as in Comparative Example 1. Test results are shown in Table 1.

COMPARATIVE EXAMPLE 3

A similar aluminum plate dipped in nitric acid and washed with tap water as stated in Comparative Example 1 was subjected to a chemical conversion treatment with a commercial chromate solution (Nippon Paint Co., Arosin) and thereafter electrodeposited and baked as in Comparative Example 1.

COMPARATIVE EXAMPLE 4

The same aluminum plate as used in Comparative Example 1 was degreased and rinsed with xylene, and immediately thereafter, subjected to the same electrodeposition coating and baking as stated in Comparative Example 1. The test results are shown in Table 1.

In the following Examples, the same aluminum material as used in the aforesaid Comparative Examples was used and electrodeposited and baked in the same ways.

EXAMPLE 1

After degreasing and rinsing the aluminum material with xylene, the same was dipped in the following multi-stage alkaline baths for 10 seconds each successively:

1st stage 4% aqueous NaOH solution

2nd stage 2% aqueous NaOH solution

3rd stage 0.4% aqueous NaOH solution 0.4% NaOH solution in the last stage corresponds to a 0.1N solution, this value having been maintained automatically with the help of pH state apparatus. That is, a sample of the last stage bath was taken periodically, its alkalinity was measured by automatic titration means, and when the alkalinity exceeded the limit of 0.1N, a quantity of deionized water having an electrical conductance of less than 10 μS/cm was allowed to flow into the bath. At the same time, a device was employed such that when the total volume of bath liquid reached the maximum capacity of the bath, an excess amount of bath liquid was allowed to overflow into the previous bath, and when the alkalinity of a bath dropped down to a lower level than the designated value, for example 0.1N, then an amount of concentrated alkali solution was supplied to compensate the same, the amount of alkali solution being automatically controlled by means of computer.

Thus, in this example, three stage alkaline baths were employed. However, for processing materials of more complicated structure, which will resuet in larger quantity of carryout bath liquid, the number of intermediary baths might be increased for effecting more easy control of the bath liquids.

As already stated, in an alkali treatment of aluminum, the said alkali will not be consumed and in principle, there is no need of replenishment thereof. The alkali etching bath is timely allowed to cool to precipitate the sludge therefrom, and the supernatant liquid is then filtered and reused. Therefore, in practice, it is necessary to supplement a small quantity of such alkali substance. In the replenishment of etching bath liquid, the required water may be supplemented by the succeeding alkaline solution. Thus, the alkali loss is suppressed to the minimum with the formation of sludge and hence, the environmental problems are markedly reduced. The whole step may be confined in a closed system and for this reason, the absence of drainage would be considered as one of the great characteristics of the method of this invention.

Supplement of deionized water is only enough to make up for the evaporated portion from the system and thus, the required quantity of water is far less than those of the heretofore known processes. It is of course very preferable that the purity of deionized water is as high as possible. However, since the required quantity is quite small, the quality control is very easy to do.

In this example, the aluminum plate was, following the abovesaid alkali treatment and without being rinsed with tap water, immediately subjected to the treatment with a series of acid baths shown below:

| | | diP. time |
|---|---|---|
| 1st stage bath | 10% chromic acid solution | 1 min. |
| 2nd stage bath | 5% chromic acid solution | 10 sec. |
| 3rd stage bath | 0.1% chromic acid solution | 10 sec. |
| 4th stage bath | deionized water having electrical conductance of less than 10 μS/cm | 10 seconds |
| 5th stage bath | deionized water having electrical conductance of less than 10 μS/cm | 10 seconds |

These baths were maintained at 50° C. in the first stage bath and at room temperature in the other stage baths and were properly vibrated. The vibration is, however, not essential in this invention.

In a continuous operation, chromic acid in the 3rd stage bath is gradually carried to the 4th stage bath which then comes over to the 5th stage bath.

Such transfer will be very remarkable in the treatment of materials of complicated structure. Under the circumstances, one may increase the number of deionized water baths having an electrical conductance of less than 10 μS/cm or supplement such deionized water to the last stage bath while allowing the bath liquid to overflow to the previous bath, thereby maintaining the specific electrical conductance in the last stage bath at a defined level of less than 10 μS/cm. Even if a chromic acid bath is to be used, there is no fear of public hazard because of the establishment of a completely closed, treating bath system.

Following the abovesaid treatment with a series of acid baths including pure water baths, the aluminum plate was immediately subjected to an electrodeposition coating and baking as in Comparative Example 1 to obtain a coated plate. Test results with this plate are shown in Table 1.

As clearly apparent from this table, the coated plate according to the present invention gives satisfactory test results in every item listed, and thus, the present method can afford far better results as compared with those of heretofore proposed processes. That is, with the etching treatments according to the known processes, the results are rather poor in respect of corrosion resistance such as sulfurous acid resistance, CASS test result or the like, whereas with the present chromic acid treatment, the results are excellent in that respect. The present method surpasses an anodic oxidation method generally used to develop surfurous acid resistance. Though the heretofore proposed chromic acid treatments have a shortcoming in surfurous acid resistance, the present method can afford perfect performance in that respect and moreover, shows excellent coating adhesion so that the treated product can be processed without fear of coat peeling even under extremely low temperature condition, e.g. −20° C. Also, in a continuous operation of heretofore proposed chromate method, it is often required to adopt extremely complicated operations for the control of bath liquid composition and sometimes it is not possible to continue the process itself. However, in the present invention, the said control is quite easy and can be automated. Therefore, a continuous operation can be steadily carried out.

EXAMPLE 2

The same procedures as given in Example 1 were repeated excepting using phosphoric acid in place of chromic acid, to obtain a coating plate. Test results are shown in Table 1.

In the sulfurous acid resistance, some inferior test results was observed as compared with the case of chromic acid in Example 1. However, the said result was far superior to those of heretofore known processes.

EXAMPLE 3

The same procedures as given in Example 1 were repeated excepting using nitric acid in place of chromic acid. This example is substantially the same as the known etching, but is characterized in that the washing step after nitric acid treatment is advantageously and effectively controlled. In the known methods, there are often cases which show inferior adhesion of the coating. However, in this example, a quite steady and satisfactory operation could be performed.

As is clear from the test results in Table 1, a degree of improvement was observed in the CASS test as compared with the heretofore known processes.

EXAMPLE 4

In this example, an additional step was added to the procedures of Example 3. That is, an additional pure water bath having an electrical conductance of less than 10 μS/cm was added at the back of the last stage water bath and the aluminum plate was dipped in this bath, while boiling, for 5 minutes. This corresponds to the so-called boehmite process. However, the present invention is characterized in that the whole step is surely kept under controlled conditions. As is clear from the test results in Table 1, quite satisfactory results were obtained.

TABLE 1

| Performance test results with coated plates | | | | | | |
|---|---|---|---|---|---|---|
| | | | | | adhesion | |
| coated plate | film thickness | $SO_2$ resistance | alkali resistance | CASS test | 20° C. | −20° C. |
| Comp. Ex. 1 | 25 μ | X | | X | | |
| Comp. Ex. 2 | 11 | X | | Δ | — | — |
| Comp. Ex. 3 | 20 | Δ | | Δ | | X |
| Comp. Ex. 4 | 18 | X | Δ | X | X | X |
| Example 1 | 21 | | | | | |
| Example 2 | 22 | Δ | | | | |
| Example 3 | 26 | X | | Δ | | |
| Example 4 | 20 | | | | | |

In the present invention, it is possible to carry out, in a chemical conversion treatment with phosphoric acid, chromic acid or the like, the treatment at a lower bath temperature than those of the known methods. Moreover, process control may be easily and surely practiced and even automated. Therefore, a hot water treatment, i.e. the boehmite process, which had not been practically used in industry, can be used and an aluminum surface treatment without the necessity of using chromium can be realized, which will surely contribute significantly to the development of related techniques.

According to the invention, an optimum condition, balancing both coating performance as corrosion resitance and coating adhesion, and economy, can be achieved by using the parameters of alkali and acid concentrations, bath temperature and dipping time, which is also an important characteristic of the present invention.

What is claimed is:

1. A method for the treatment of aluminum material comprising treating the aluminum material in regular succession in treating baths connected in a series of multi-stage alkaline baths and multi-stage acid baths, said alkaline baths having an alkali concentration gradient continually decreasing from 3N to a lower value, the alkali concentration in the last stage bath being controlled to a defined level of $1\times10^{-6}$–$5\times10^{-4}$N, and the acid baths having an acid concentration gradient continually decreasing from 3N to a lower value, the last stage bath liquid being deionized water having a specific electrical conductance of less than 10 μS/cm.

2. A method according to claim 1, wherein the acid bath liquid is phosphoric or chromic acid type chemical conversion liquid.

3. A method according to claim 1, wherein the acid bath liquid is nitric acid, sulfuric acid or perchloric acid solution.

4. A method according to claim 3, wherein the aluminum material is, after the treatment with the deionized water, subjected to a hot water treatment.

* * * * *